United States Patent [19]

Hugunin

[11] Patent Number: 5,011,152

[45] **Date of Patent: * Apr. 30, 1991**

[54] STALL ENCLOSURE FOR ALL-WEATHER GOLF DRIVING RANGE

[76] Inventor: Harvey W. Hugunin, 114 Myers Rd., Liverpool, N.Y. 13088

[ * ] Notice: The portion of the term of this patent subsequent to Dec. 26, 2006 has been disclaimed.

[21] Appl. No.: 415,855

[22] Filed: Oct. 2, 1989

Related U.S. Application Data

[63] Continuation-in-part of Ser. No. 224,385, Jul. 26, 1988, Pat. No. 4,889,342.

[51] Int. Cl.[5] ..... A63B 69/36; F24F 9/00; F24F 13/00

[52] U.S. Cl. ..... 273/176 R; 273/35 B; 273/195 R; 98/40.01; 98/39.1; 98/36

[58] Field of Search ..... 273/35 R, 35 B, 32 R, 273/32 D, 176 R, 176 L, 62, 195 R; 219/385; 52/199; 206/315.9; 34/202, 90; 98/36, 101, 114, 121.1, 42.22, 40.01, 39.1

[56] References Cited

U.S. PATENT DOCUMENTS

| | | | |
|---|---|---|---|
| 3,023,689 | 3/1962 | Kurek | 98/101 X |
| 3,236,171 | 2/1966 | Vaskov et al. | 98/114 |
| 3,301,162 | 1/1967 | Zumbiel | 98/36 |
| 3,683,155 | 8/1972 | Loofbourow | 273/62 X |
| 3,860,236 | 1/1975 | Buchanan | 273/35 B |
| 3,864,889 | 2/1975 | Hobbs | 98/114 X |
| 4,109,433 | 8/1978 | Maze | 52/199 |

*Primary Examiner*—Edward M. Coven
*Assistant Examiner*—Sebastiano Passaniti
*Attorney, Agent, or Firm*—Charles S. McGuire

[57] ABSTRACT

A stall-type enclosure for use by a golfer at a driving range having an under-floor plenum for receiving heated air and allowing it to rise through a grating covering the plenum in an area around a mat structure upon which the golfer stands. The plenum is surrounded by an insulating wall and heat either leaking or radiating from the sides of the plenum also rises through the grating from the insulated region. The enclosure has a rearwardly pitched roof providing a space behind the front wall and above the opening therein for collection of heated air which is returned to a rear compartment of the structure wherein the heater is located. The mat structure is preferably movable on the grating to allow positioning for optimum wind protection, and hinged flaps or dampers may be selectively placed in covering relation to portions of the grating to concentrate the areas through which heat rises. A ball container is preferably positioned adjacent the mat structure to receive heat rising through the grating.

21 Claims, 5 Drawing Sheets

STALL ENCLOSURE FOR ALL-WEATHER GOLF DRIVING RANGE

REFERENCE TO RELATED APPLICATION

This is a continuation-in-part of copending application Ser. No. 224,385, filed July 26, 1988, now U.S. Pat. No. 4,889,342.

REFERENCE TO RELATED DISCLOSURE DOCUMENTS

This application is based upon material contained in the following Disclosure Documents:

No. 172,489 dated June 25, 1987;
No. 176,999 dated Sept. 8, 1987;
No. 178,834 dated Oct. 2, 1987; and
No. 181,904 dated Nov. 30, 1987.

BACKGROUND OF THE INVENTION

This invention relates to stall-type enclosures for use at a golf driving range, or the like, to provide a comfortable environment for a golfer using the driving range during inclement weather conditions.

Temperature-controlled tee areas have been provided in a number of configurations for use at golf driving ranges, and the like. For example, U.S. Pat. No. 4,045,023 of Heffley, Jr. discloses a driving booth equipped with air circulation means extending across the upper side of the opening through which balls are driven to circulate a curtain of heated or cooled air over the opening. A similar temperature control means is that of Buchanan U.S. Pat. No. 3,860,236, wherein air is directed downwardly across the open front of the enclosure to provide an "air door" which tends to maintain a desired temperature therein. In Mowrer U.S. Pat. No. 3,861,680, a radiant heater is positioned within the booth or stall, directly above the golfer.

The use of downwardly-directed, forced air curtains, or radiant heat may be effective in some circumstances, but is not particularly efficient. Nor do such systems provide effective distribution of heat throughout the playing area within the enclosure.

It is a principal object of the present invention to provide a novel and improved stall-type enclosure for use by a golfer at a golf driving range during inclement weather conditions.

A further object is to provide an effective and efficient heating system for a stall-type enclosure having an open front through which golf balls may be driven.

Another object is to provide a stall-type enclosure for use at a golf driving range wherein comfort heating is provided throughout the playing area, and air curtains or similar downflow heating systems are eliminated.

A still further object is to provide a heated enclosure for use at a golf driving range, having a novel and improved relationship of the heating system and the mat or other surface from which the ball is driven.

An additional object is to provide a stall-type enclosure for use at a golf driving range and having cooperative means for heating the playing area of the enclosure and warming the balls as they are fed to the location from which they are driven.

Other objects will in part be obvious and will in part appear hereinafter.

SUMMARY OF THE INVENTION

In accordance with the foregoing objects, the invention contemplates an all-weather golf driving range housing unit or enclosure of the single-user, stall-type which includes a floor, roof, back and side walls having an open front through which a golfer may drive the ball by executing a full swing of the golf club. The open front preferably includes movable doors, allowing the housing to be closed when not in use. The roof slopes downwardly from front to rear, whereby the sides are trapezoidal in shape.

A heating unit is installed in a rear part of the structure, separated from the compartment in which the golfer stands by a partition. The hot-air outlet of the heater is connected to or placed within one end of a duct which is connected at its other end to a warm air plenum. A fan in the duct circulates air from the heater to the plenum which is suspended below a grating of spaced, inverted U-channel members.

The plenum has a rectangular upper periphery which abuts the lower edges of the channel members and is smaller than the rectangular outline of the grating area. A wall of insulating material is positioned around the plenum, in spaced relation thereto, extending from the underside of the grating to the ground. A solid mat, preferably of multi-layer construction, having a rectangular periphery smaller than that of the upper end of the plenum is placed upon the grating to provide a surface from which to drive the ball and upon which the golfer stands.

With the mat centrally positioned on the grating, forced hot air from the plenum rises through the spaces between the channel members around the entire periphery of the mat. In addition, warm air from within the area between the plenum and the insulating wall rises by convection through the grating about the outer perimeter thereof. Preferably, the mat may be moved to any desired position on the grating in order to place the golfer at a position within the enclosure wherein warm air rises between the golfer and any wind which may enter the enclosure. Also, hinged flaps may be provided along the sides of the grating to permit selective covering of the areas on one or both sides of the mat, thereby concentrating the heated area forwardly, rearwardly, and/or at either side of the mat.

As a further refinement of the invention, a sloped ball-supply bin is positioned at one side of the mat, over a portion of the grating. The lower wall of the bin has openings smaller than the golf balls through which air may pass as it rises through the grating. Thus, the balls, which may be supplied from an unheated area, may be warmed to a temperature closer to that within the enclosure before being struck, thereby having a more realistic flight.

The foregoing, generally described features, as well as others, will be more fully understood and appreciated from the following detailed description, taken in conjunction with the accompanying drawings, wherein:

DETAILED DESCRIPTION

Figure 1:
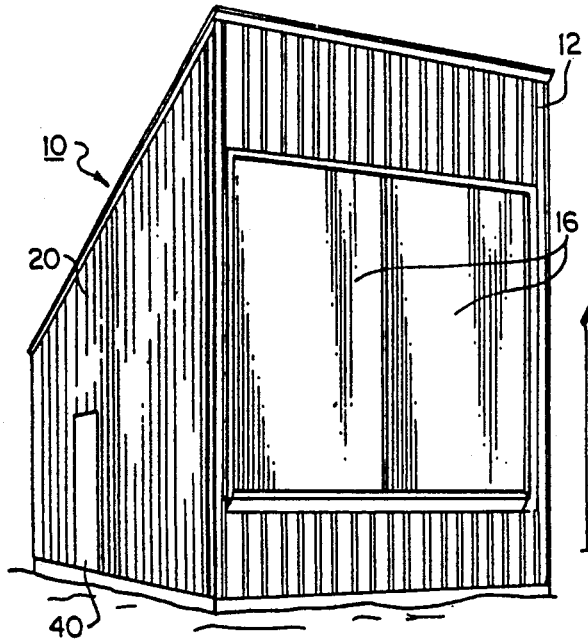
FIG. 1 is a front perspective view of the golf driving range enclosure of the invention with doors on the front side shown in the closed position.
Figure 2:
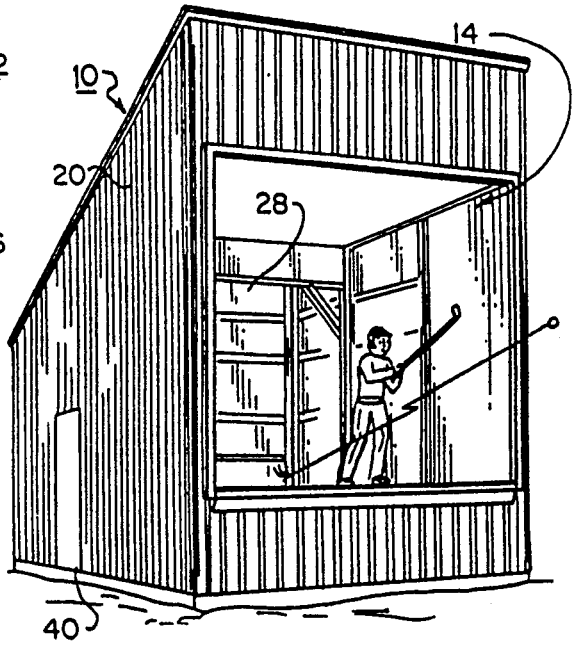
FIG. 2 is a perspective view, as in FIG. 1, showing the doors in the open position and a golfer driving a ball from the enclosure.
Figure 3:
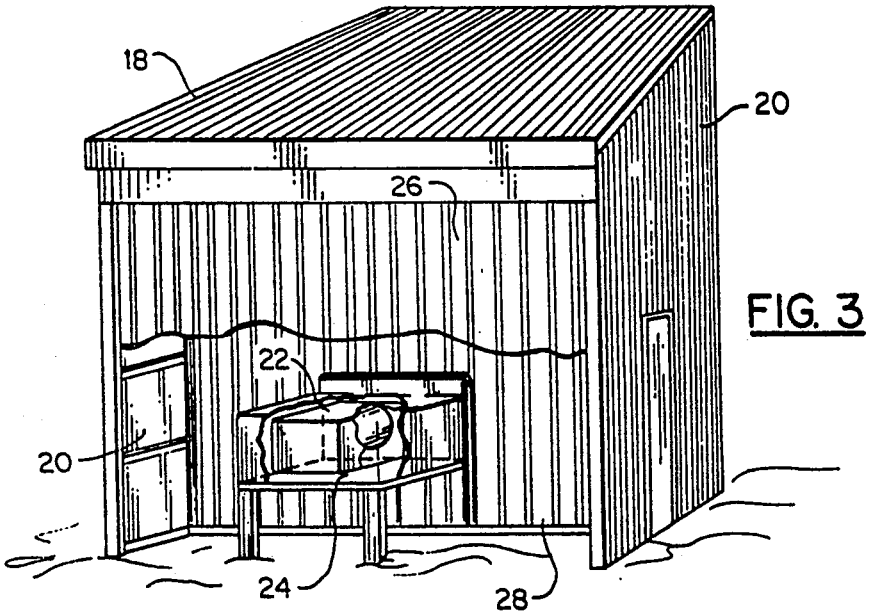
FIG. 3 is a rear perspective view of the enclosure, with portions broken away.

Referring now to the drawings, in FIGS. 1-3 is shown a preferred embodiment of the stall-type enclosure of the invention, denoted generally by reference numeral 10. Enclosure 10 includes front wall 12 having frontal opening 14 which may be closed by doors 16, as in FIG. 1, or open when the enclosure is in use, as in FIG. 2. Roof 18 slopes downwardly from front to rear, providing side walls 20 of trapezoidal shape. Heater unit 22 is supported above ground level on platform 24 between rear wall 26 and interior, transverse partition 28 of enclosure 10.

Figure 3A:
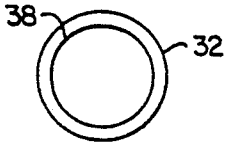
FIGS. 3*a* and 3*b* are end and side elevational views, respectively, of portions of the apparatus shown in FIG. 3.
Figure 3B:
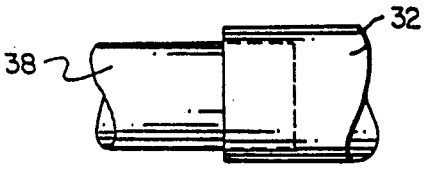
Figure 4A:
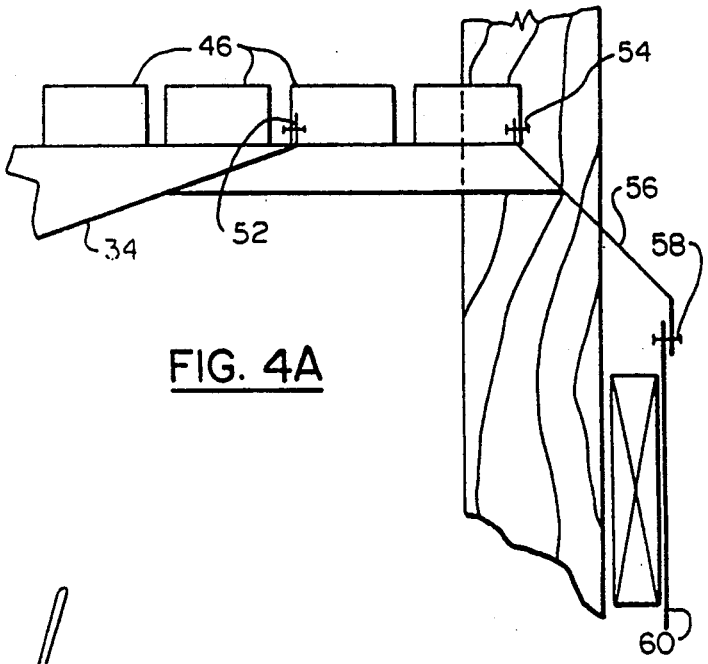
FIG. 4*a* is an enlarged, fragmentary detail of a portion of FIG. 4, taken on the line 4A—4A of FIG. 5.
Figure 4:
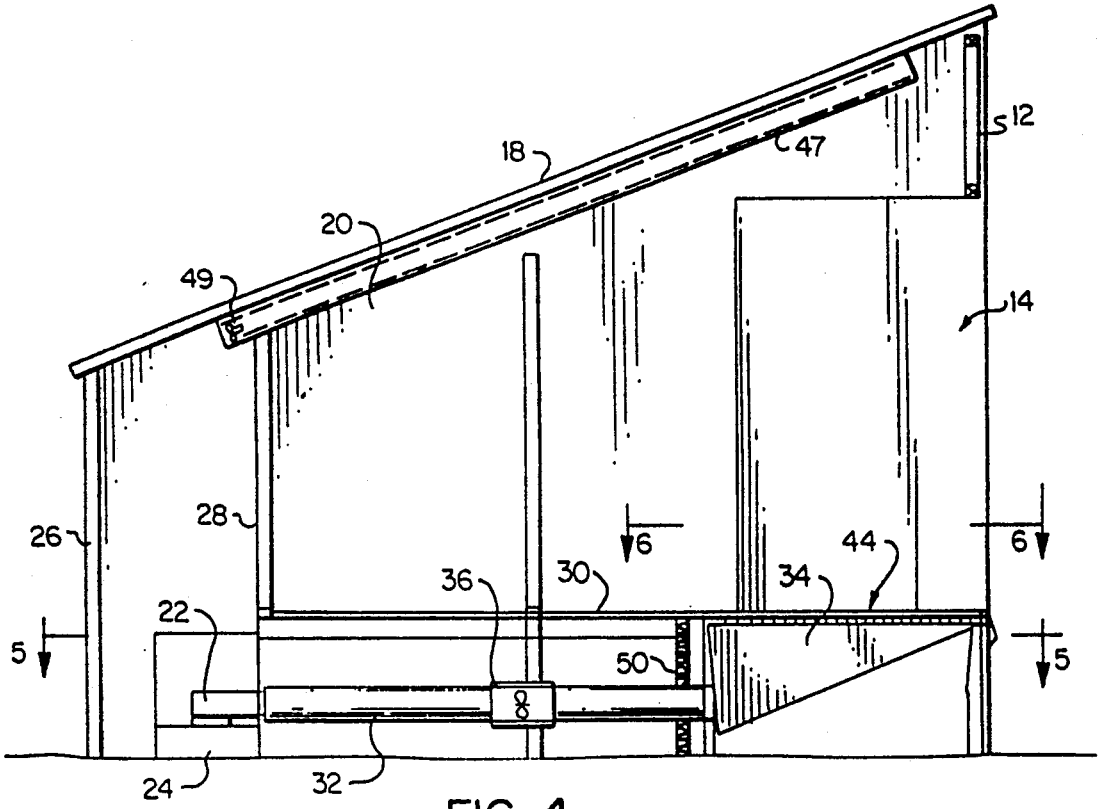
FIG. 4 is a side elevational view of the enclosure in vertical section.
Figure 5:
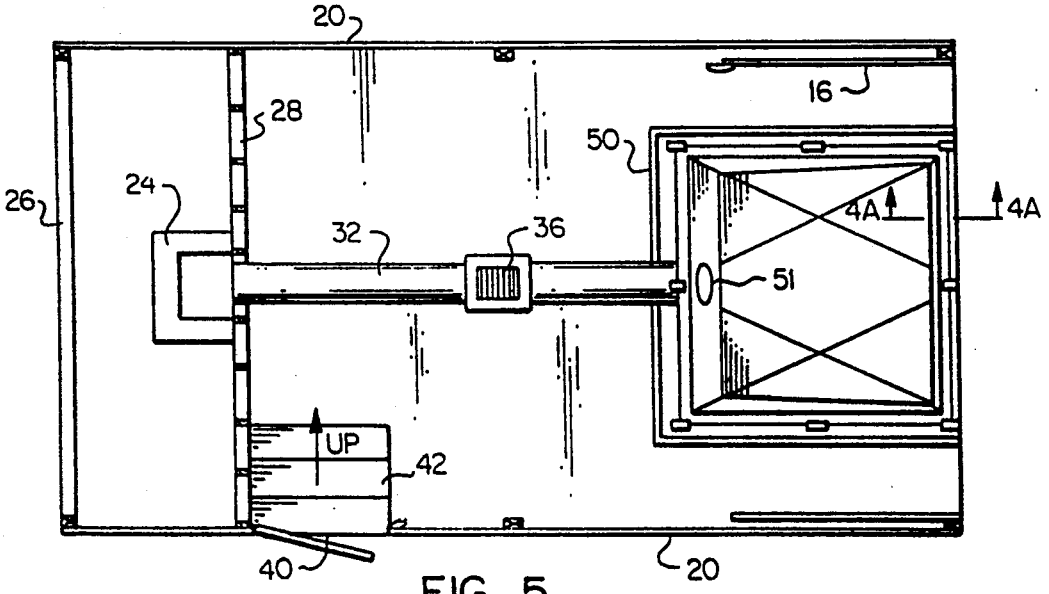
FIG. 5 is a plan view, in section on the line 5—5 of FIG. 4.
Figure 6:
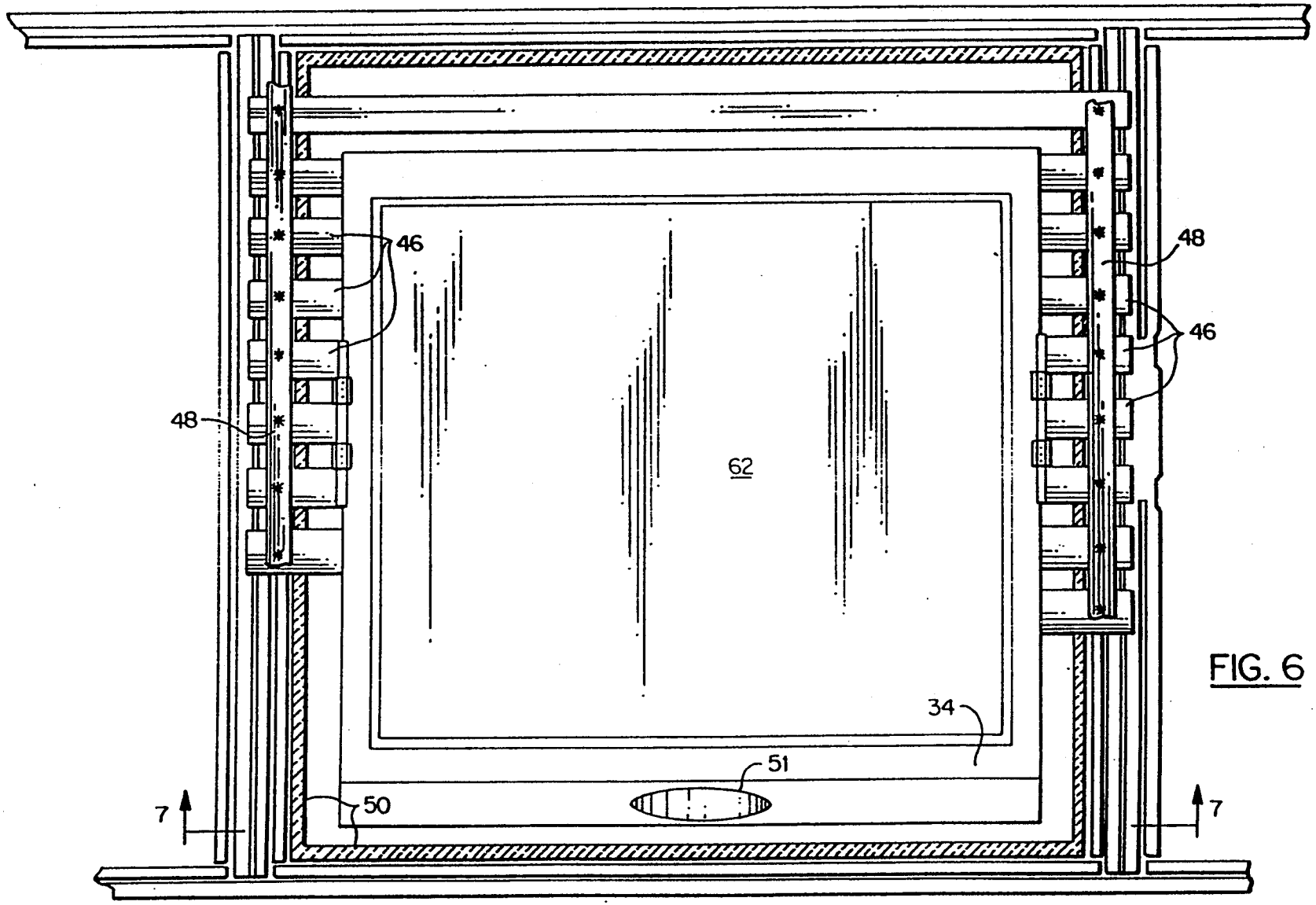
FIG. 6 is an enlarged, fragmentary plan view of a portion of FIG. 5, taken on the line 6—6 of FIG. 4.

The floor of housing 10, indicated in FIG. 4 by reference numeral 30, is supported above ground level by a distance providing space for mounting duct 32 and plenum 34, to which hot air is conducted from heater unit 22 by duct 32, assisted by duct fan 36. The hot air outlet tube 38 of heater unit 22 preferably is slightly smaller cross section than duct 32 and extends a short way into the duct without physical attachment thereto, as seen in FIGS. 3*a* and 3*b*. Door 40 in one of side walls 20 provides access to and from the interior of enclosure 10, and stairs 42 (FIG. 5) are provided between ground level and floor 30. Another door or other passageway (not shown) is provided for access to the space between rear wall 26 and partition 28.

A rectangular section of floor 30 extending fully or partially across the width of housing 10, and from opening 16 rearwardly for a portion of the depth of the housing is in the form of an open grating 44. In a preferred construction, grating 44 comprises a plurality of parallel, spaced, elongated channel members 46 of inverted U-shaped configuration, joined by strips 48 extending along opposite sides of grating 44 and riveted, welded, or otherwise attached to each of channel members 46. Grating 44 is of larger length and width than the upper periphery of plenum 34, and is positioned above the plenum, entirely covering the open, upper side, and extending outwardly on both sides and rearwardly thereof.

Figure 7:
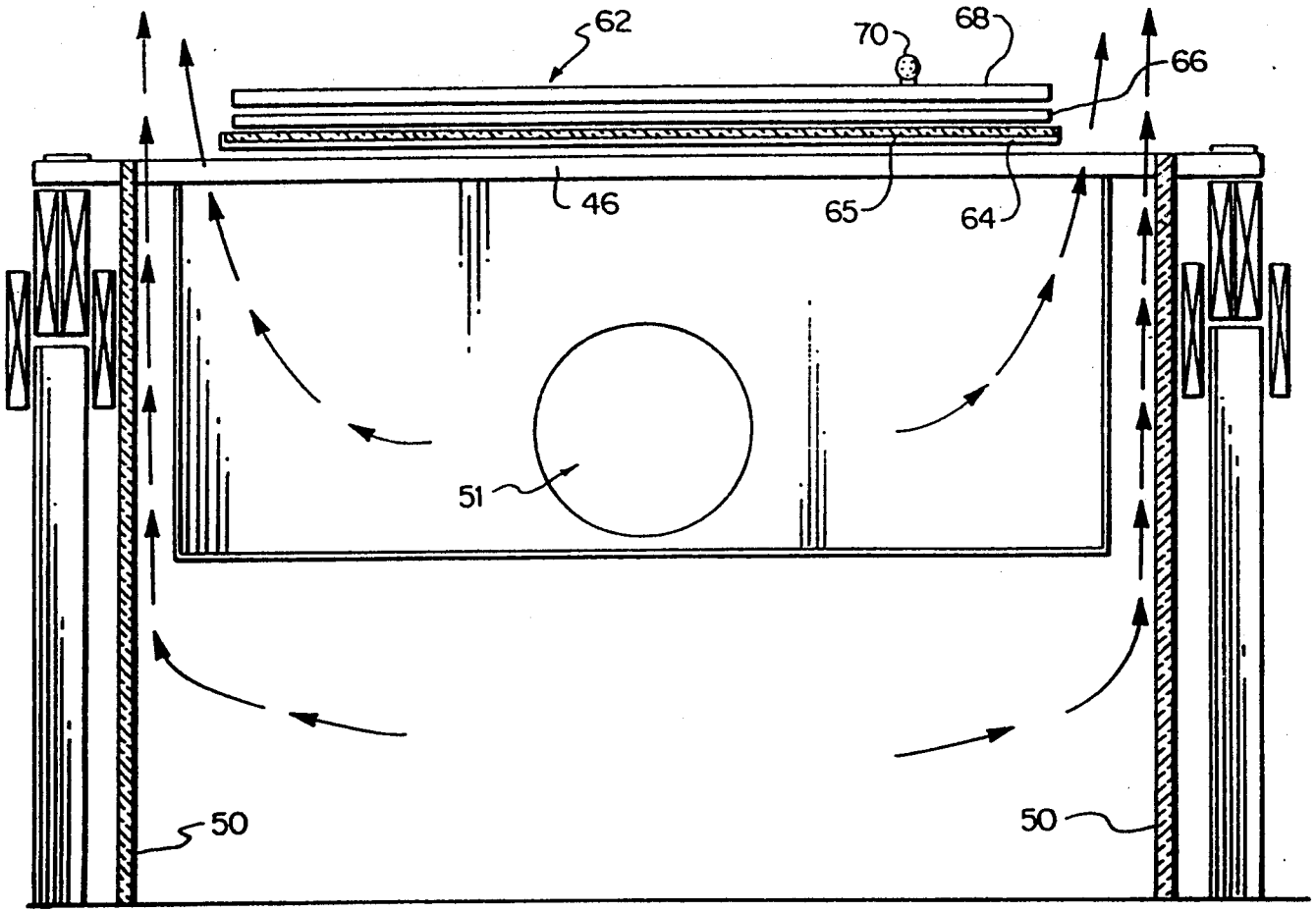
FIG. 7 is a rear elevational view, in section on the line 7—7 of FIG. 6.

Vertical wall 50 surrounds plenum 34, having a rectangular periphery somewhat smaller than that of grating 44. Wall 50 extends between the lower side of grating 50 and the ground, separating the air surrounding plenum 34 from the space under enclosure 10 outside of wall 50. Wall 50 is constructed of a thermal insulating material, such as a low-density, rigid, foam plastic, fiberglass, or the like, and serves to contain any heat passing through the walls of plenum 34 either by conduction or leakage. The air within wall 50, when warmer than ambient air, rises through the spaces in grating 44 outside of the forced hot air from within plenum 34, as shown in FIG. 7. In installations where the flow of air from within wall 50 is expected to be fairly high, openings may be provided around the lower periphery of the wall for entry of air from the surrounding wall 50. Tubular conduit 47 may be provided along the upper, interior surface of roof 18, as shown in FIG. 4, to circulate warm air which may gather at the upper, forward part of enclosure 10 into the space between partition 28 and rear wall 26, assisted by fan 49, in order to raise the temperature of air entering heater 22.

The bottom side of plenum 34 preferably slopes upwardly from the rear side, having opening 51 connecting with duct 32, to the front edge, which may be bent upwardly and attached by rivets 52 to one of channel members 46, as shown in FIG. 4*a*. In addition to rivets 52, plenum 34 is supported beneath grating 44 along each lateral side, and/or the rear side, by riveting or welding overlapping portions of the plenum and the channel members, or by any other convenient means. As also seen in FIG. 4*a*, drip plate 54 is affixed by rivets 56 at its upper edge inside the frontmost channel member 46, and by rivets 58 on the outside of siding material 60 which covers the front, back and sides of enclosure 10. Drip plate 54 provides an effective means for preventing precipitation from entering enclosure 10 at the lower side of opening 14, as well as inhibiting ice build-up in this area.

A rigid, rectangular, mat structure, denoted generally by reference numeral 62, having a peripheral outline smaller than the open, upper side of plenum 34, is placed on channel members 46. Mat structure 62 preferably includes four layers, as shown in FIG. 7, namely, a lower metal plate 64, a layer of insulating material 65, a wooden layer 66, and an upper resilient layer 68 of carpeting or artificial turf. Golf ball 70 is placed either directly on the surface of mat 62, or on a tee or other support, to be driven by a golfer also standing on mat 62.

Figure 8:
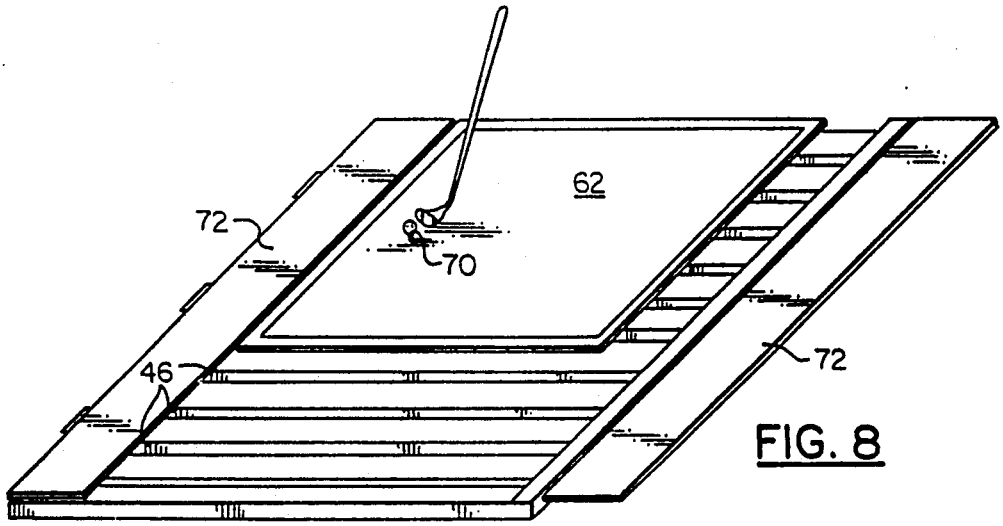
FIG. 8 is a perspective view showing a modified version of a portion of the structure.

It is preferred that mat 62 be movable upon channel members 46 to permit selective positioning in areas wherein heated air rising through the channel members is positioned between the golfer and any wind which may enter enclosure 10. As a further refinement, in order to concentrate the heat rising through the grating provided by channel members 46, flaps 72 may be hingedly attached along the sides of the grating, as shown in FIG. 8. Either or both of flaps 72 may be selectively placed in either covering or uncovering relation to the sides of the grating which, in conjunction with the positioning of mat 62, will control the portions of the grating through which warm air rises.

Figure 9:
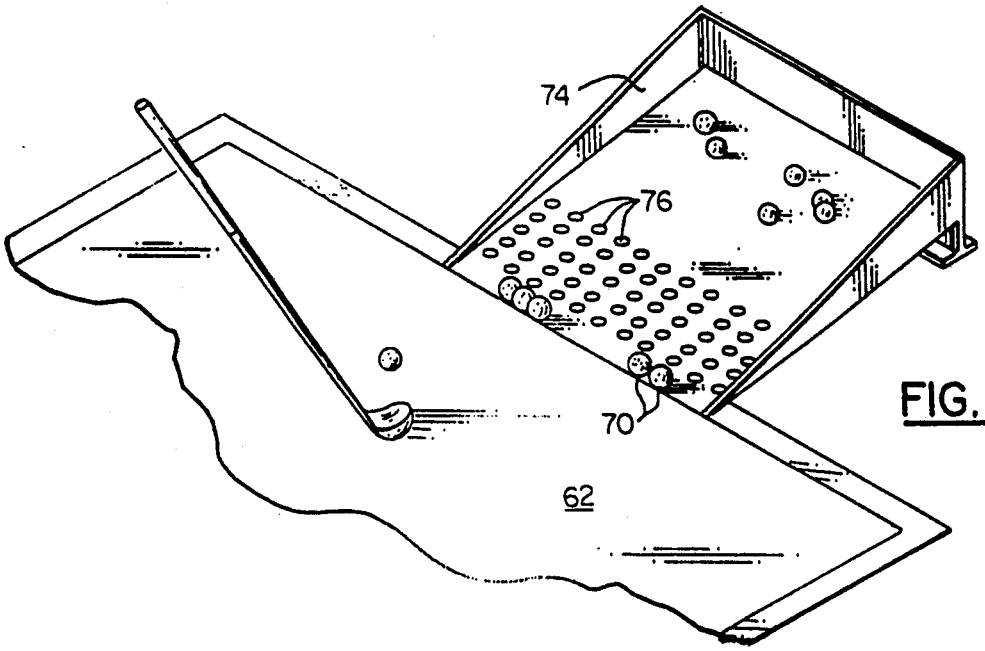
FIG. 9 is a perspective view of an optional ball supply and warming means in combination with other portions of the structure.

Since the golf balls may be stored in an unheated area, it is desireable to provide some means for bringing them more rapidly to the ambient temperature within enclosure 10. To this end, ball tray 74 is positioned laterally adjacent mat 62, as shown in FIG. 9. Tray 74 may slope downwardly somewhat towards its forward edge abutting mat 62, which provides a lip holding the balls in position within the tray until the golfer is ready to place them on the mat. Openings 76, having diameters less than that of golf balls 70, are provided in at least the forward portion of the lower wall of tray 74 which overlies portions of channel members 46. Thus, warm air rising through the grating may pass through openings 76 and bring the temperature of the balls closer to that within enclosure 10 before they are struck by the golf club.

From the foregoing, it may be seen that the invention provides an improved enclosure permitting comfortable use of a golf driving range in cold or inclement weather. The playing area is heated by air rising through an open grating which covers, and has a peripheral boundary larger than, the open top of a warm air plenum. A mat structure for supporting the golfer and ball is placed on the grating and has a peripheral boundary smaller than that of the top of the plenum.

A wall of insulating material is preferably placed around the plenum, in spaced relation thereto, permitting any heat lost through the walls of the plenum to also rise through the grating.

Other, optional features include selectively positionable flaps or dampers to control the areas of the grating through which warm air rises, and means for bringing the temperature of the balls up to the ambient temperature of the enclosure. Further preferred features include dimensioning the elements such that the cross sectional area of duct 32 is substantially equal to the area of the grating above plenum 34 which is not covered by mat structure 62, and sloping the roof of the enclosure from front to rear at about a 3:5 pitch.

What is claimed is:

1. A stall-type enclosure for use by a golfer at a driving range during inclement weather, said enclosure comprising:

(a) a roof and side, back and front walls, said front wall having an opening through which a ball may be driven by a golfer standing within said enclosure and executing a full swing;

(b) a floor within said enclosure elevated above ground level to provide an enclosed space beneath said flooring;

(c) an air plenum positioned within said enclosed space, said plenum having an open top of first, predetermined outline;

(d) means providing heated air to said plenum;

(e) a predetermined section of said flooring comprising an open grating, having a second, predetermined outline, larger than said first outline, a first portion of said grating being positioned directly above said open top of said plenum, in fully covering relation thereto; and (f) a mat adapted for supporting said golfer and ball, said mat being positioned upon said first portion of said open grating and having a third, predetermined outline, smaller than said first outline, whereby said heated air may rise through said open grating in an area at least partially surrounding said mat.

2. The stall-type enclosure of claim 1 wherein said first, second and third predetermined outlines are rectangular and both the length and width of said first outline are less than the length and width of said second outline, and greater than the length and width of said third outline.

3. The stall-type enclosure of claim 2 wherein said mat is positioned with its periphery entirely within said first predetermined outline, whereby said heated air may rise through said open grating in an area entirely surrounding said mat.

4. The stall-type enclosure of claim 1 and further including a substantially vertical wall of insulating material within said enclosed space entirely surrounding said plenum in spaced relation thereto and extending substantially between the lower side of said open grating and ground level, whereby heated air may rise through said grating from the space between said plenum and said wall.

5. The stall-type enclosure of claim 4 wherein said wall is rigid, heating-insulating material and has a fourth, predetermined outline in plan view, not greater than said second outline.

6. The stall-type enclosure of claim 1 wherein said plenum is suspended from said open grating.

7. The stall-type enclosure of claim 6 wherein said open grating comprises a plurality of spaced, parallel, U-shaped channel members.

8. The stall-type enclosure according to claim 7 wherein said plenum is physically attached to at least some of said channel members.

9. The stall-type enclosure according to claim 7 and further including a pair of solid dampers and extending respectively along opposite, lateral sides of said grating for individual, selective placement in covering and uncovering relation to lateral portions of said open grating, thereby controlling the areas of said grating through which heated air rises.

10. The stall-type enclosure of claim 1 and further including a container for holding a supply of golf balls, said container having a bottom wall with perforations therein of smaller cross section than said golf balls, at least a portion of said bottom wall being positioned above said first portion of said grating, whereby at least some golf balls in said container receive heat from said plenum.

11. The stall-type enclosure of claim 10 wherein said bottom wall has an edge portion disposed adjacent one side of said mat and said bottom wall is inclined toward said edge portion, whereby golf balls in said container are fed by gravity toward said edge portion.

12. The stall-type enclosure of claim 1 wherein said roof is sloped from said front to said back wall at about a 3:5 pitch, whereby said side walls are trapezoidal in shape.

13. The stall-type enclosure of claim 12 and further including an internal space directly behind said front wall and above said opening therein, whereby heat rising through said grating may accumulate in said internal space, and means for recirculating air from said enclosed space to a rear portion of said enclosure.

14. The stall-type enclosure of claim 13 and further including a partition parallel to and intermediate of said front and back walls, and wherein said enclosed space is between said partition and said front wall.

15. The stall-type enclosure of claim 1 wherein said mat is selectively movable upon said grating to permit positioning of said mat in positions wherein said heated air rising through said open grating is positioned between the golfer and any wind entering said enclosure through said opening.

16. The stall-type enclosure of claim 1 and further including a partition parallel to and between said front and back walls, said means providing heated air being positioned in the space rearwardly of said partition and said plenum being positioned in the space forwardly of said partition.

17. The stall-type enclosure of claim 16 wherein said means providing heated air comprises a heater with a circular heat outlet, and further including a circular duct communicating at one end with said heat outlet and at the other end with said plenum.

18. The stall-type enclosure of claim 17 wherein said duct is of larger diameter than said heat outlet, and said heat outlet extends into said one end of said duct and is physically unattached thereto, providing an open, annular space between said heat outlet and said duct.

19. The stall-type enclosure of claim 1 wherein said means providing heated air communicates with said plenum through a duct pipe having a cross sectional area substantially equal to said first portion of said grating not covered by said mat.

20. The stall-type enclosure of claim 1 wherein said mat comprises a multi-layer structure having at least two, superposed layers the lower of which provides an insulating barrier for the upper of said layers.

21. The stall-type enclosure of claim 1 wherein said front wall opening has parallel, upper and lower edges, said upper edge being positioned a substantial distance below the top of said front wall, thereby providing an internal space directly behind said front wall and above said opening, and said lower edge being positioned a substantial distance above the bottom of said front wall, substantially at the level of said flooring.

* * * * *